US007259757B2

(12) United States Patent
Maehara

(10) Patent No.: US 7,259,757 B2
(45) Date of Patent: Aug. 21, 2007

(54) IMAGE SIGNAL PROCESSING DEVICE

(75) Inventor: Toshio Maehara, Koufu (JP)

(73) Assignees: Pioneer Corporation, Tokyo (JP); Pioneer Micro Technology Corporation, Yamanashi-ken (JP)

( * ) Notice: Subject to any disclaimer, the term of this patent is extended or adjusted under 35 U.S.C. 154(b) by 600 days.

(21) Appl. No.: 10/799,891

(22) Filed: Mar. 15, 2004

(65) Prior Publication Data

US 2004/0178985 A1 Sep. 16, 2004

(30) Foreign Application Priority Data

Mar. 14, 2003 (JP) ..... 2003-069709

(51) Int. Cl.
*G09G 5/00* (2006.01)

(52) U.S. Cl. ..... 345/204; 345/100; 345/699

(58) Field of Classification Search ..... 345/60, 345/76, 77, 83–84, 87, 88–89, 92–94, 98–99, 345/204, 690, 698–699, 100; 341/87, 95, 341/154–155, 126

See application file for complete search history.

(56) References Cited

U.S. PATENT DOCUMENTS 5,790,705 A * 8/1998 Anderson et al. ..... 382/244
5,870,049 A * 2/1999 Huang et al. ..... 341/144
6,198,419 B1 * 3/2001 Wen ..... 341/145
6,700,559 B1 * 3/2004 Tanaka et al. ..... 345/88

FOREIGN PATENT DOCUMENTS

EP 0458169 A2 * 11/1991
JP 2002-043944 A 2/2002

* cited by examiner

*Primary Examiner*—Richard Hjerpe
*Assistant Examiner*—Mansour M. Said
(74) *Attorney, Agent, or Firm*—Sughrue Mion, PLLC

(57) ABSTRACT

An object is to provide an image signal processing device capable of converting digital image signals into analog image signals using a circuit of small scale. Addition high-order bit pixel data is generated by adding, to high-order bit pixel data comprising an high-order consecutive bits of input pixel data, a value corresponding to the least significant bit digit of the high-order bit pixel data. In a prescribed period, during a time period corresponding to a value of low-order bit pixel data comprising low-order consecutive bits of the input pixel data, the addition high-order bit pixel data is taken to be the data for D/A conversion, and in other period, the high-order bit pixel data is taken to be the data for D/A conversion. By means of this configuration, even when the resolution of a D/A converter is lower than the resolution required by the input pixel data, the resolution of the image ultimately viewed during the prescribed period is equivalent to the resolution required by the input pixel data. Consequently, to the extent that the resolution of the D/A converter can be lowered, the circuit scale can be reduced.

5 Claims, 6 Drawing Sheets

IMAGE SIGNAL PROCESSING DEVICE

BACKGROUND OF THE INVENTION

1. Field of the Invention

This invention relates to an image signal processing device which converts a digital image signal into an analog image signal.

2. Description of the Related Art

At present, a liquid crystal driving device which for example drives an active-matrix liquid crystal display panel is provided with a D/A converter which converts an input digital image signal into an analog image signal.

For example, the D/A converter disclosed in Japanese Patent Application Kokai No. 2002-43944 generates various intermediate voltages in advance corresponding to the levels of the analog signals to be output, and from among these intermediate voltages selects and outputs intermediate voltages corresponding to input digital image signals.

Hence in the above D/A converter, the greater the number of bits in the input digital image signal, that is, the higher the required resolution, the greater the number of intermediate voltages which must be generated, resulting in the problem of an increase in circuit scale.

The present invention was devised in order to resolve this problem, and has as an object the provision of an image signal processing device capable of converting digital image signals into analog image signals using a small-scale circuit.

SUMMARY OF THE INVENTION

The image signal processing device of one aspect of the present invention which converts input pixel data corresponding to individual pixels of a display panel into analog image signals, comprises a calculation portion for adding high-order bit pixel data to a value corresponding to the least significant bit digit in the high-order bit pixel data to obtain addition high-order bit pixel data, the high-order bit pixel data being constituted by high-order consecutive bits of the input pixel data; a selection portion for selecting either the addition high-order bit pixel data or the high-order bit pixel data in accordance with a value of low-order bit pixel data, the low-order bit pixel data being constituted by low-order consecutive bits of the input pixel data; and a D/A conversion portion for performing digital-to-analog conversion of the selected pixel data to obtain the analog image signal.

The image signal processing device of another aspect of the present invention which converts input pixel data corresponding to individual pixels of a display panel into analog image signals, comprises a D/A conversion portion for performing digital-to-analog conversion processing of high-order bit pixel data comprising high-order consecutive bits in the input pixel data to obtain an analog signal; and a calculation portion for outputting an addition result, as the analog image signal, of the analog signal and a value corresponding to the least significant bit digit in the high-order bit pixel data in accordance with a value of low-order bit pixel data, the low-order bit pixel data being constituted by low-order consecutive bits of the input pixel data.

DETAILED DESCRIPTION OF THE INVENTION

Figure 1:
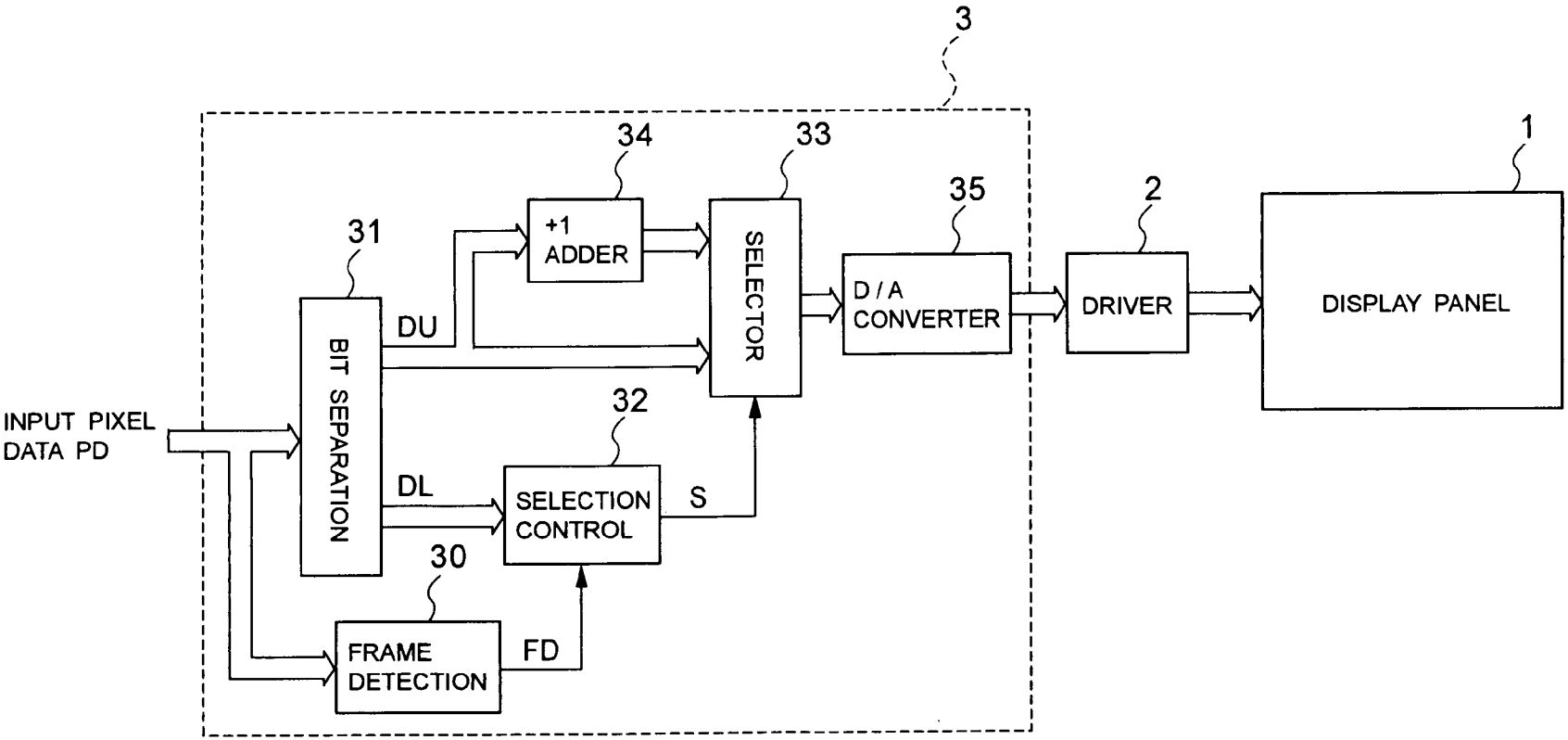
FIG. 1 shows the schematic configuration of a display device provided with an image signal processing device of this invention.

Below, embodiments of this invention are explained in detail, referring to the drawings.

FIG. 1 shows the schematic configuration of a display device provided with an image signal processing device of this invention.

In FIG. 1, the display panel 1 is a display panel, such as a liquid crystal display panel, electroluminescence display panel, or plasma display panel, in which the pixel cells which represent each pixel are arranged in a matrix. The driver 2 generates and supplies to the display panel 1 various driving signals to cause display on the screen of the display panel 1 of an image corresponding to analog image signals supplied by the image signal processing device 3.

The image signal processing device 3 comprises a frame detection circuit 30, bit separation circuit 31, selection control circuit 32, selector 33, +1 adder 34, and D/A converter 35.

The frame detection circuit 30 generates a frame detection signal FD each time one frame's worth of input pixel data PD corresponding to pixels of the display panel 1 is supplied, and supplies the frame detection signal FD to the selection control circuit 32. The input pixel data PD is N bits of digital data; the brightness level at which emission in each of the pixels is to occur is expressed by N bits.

The bit separation circuit 31 separates the N bits of input pixel data PD into a low-order bit sequence comprising low-order consecutive M bits (where M is a natural number smaller than N) including the least significant bit, and a high-order bit sequence comprising high-order consecutive (N-M) bits including the most significant bit of the input pixel data PD. The bit separation circuit 31 supplies the low-order bit sequence, as low-order bit pixel data DL, to the selection control circuit 32, and supplies the high-order bit sequence, as high-order bit pixel data DU, to the selector 33 and to the +1 adder 34.

The +1 adder 34 supplies to the selector 33 the (N-M) bits of addition high-order bit pixel data $DU_{ADD}$ obtained by adding "1" to the least significant bit of the (N-M) bits of the high-order bit pixel data DU. That is, the addition high-order bit pixel data $DU_{ADD}$ is obtained by, so to speak, carrying from the least significant bit sequence, by adding a value corresponding to the least significant bit digit of the high-order bit pixel data DU to the high-order bit pixel data DU.

The selection control circuit 32 first detects, based on the frame detection signal FD, whether $2^M$ frame's worth of input pixel data PD has been supplied. Each time it is detected that $2^M$ frame's worth of input pixel data PD has been supplied, the selection control circuit 32 captures the low-order bit pixel data DL for each pixel, based on one frame's worth of input pixel data PD. Based on the low-order bit pixel data DL for each pixel in the capture frame's worth of data, the selection control circuit 32 then generates a selection signal S which indicates which among the high-order bit pixel data DU and the addition high-order bit pixel data $DU_{ADD}$ is to be selected in each frame at each of the subsequent following $2^M$ frame processing period. Here, in the above-described $2^M$ frame processing period, the selection control circuit 32 generates and supplies to the selector 33 a selection signal S indicating, for frames corresponding in number to the value of the low-order bit pixel data DL, the addition high-order bit pixel data $DU_{ADD}$, and for other frames, the high-order bit pixel data DU.

For example, when the number of bits M in the low-order bit sequence separated in the bit separation circuit 31 is 1, the selection control circuit 32 performs operations as follows.

First, when the low-order bit pixel data DL is "0", the selection control circuit 32 constantly supplies to the selector 33 a selection signal S causing selection of the high-order bit pixel data DU. When the low-order bit pixel data DL is "1", the selection control circuit 32 supplies to the selector 33, in each two-frame processing period, a selection signal S causing selection of the addition high-order bit pixel data $DU_{ADD}$ in the first frame, and of the high-order bit pixel data DU in the second frame.

When, in the bit separation circuit 31, the number of bits M separated in the low-order bit sequence is 2, the selection control circuit 32 performs operations as follows.

When the low-order bit pixel data DL is "00", the selection control circuit 32 always supplies to the selector 33 a selection signal S causing selection of the high-order bit pixel data DU. When the low-order bit pixel data DL is "01", the selection control circuit 32 supplies to the selector 33, in each four-frame processing period, a selection signal S causing selection of addition high-order bit pixel data $DU_{ADD}$ in the second frame, and of high-order bit pixel data DU in the first, third and fourth frames. When the low-order bit pixel data DL is "10", the selection control circuit 32 supplies to the selector 33, in each four-frame processing period, a selection signal S causing selection of addition high-order bit pixel data $DU_{ADD}$ in the first and third frames, and of high-order bit pixel data DU in the second and fourth frames. And, when the low-order bit pixel data DL is "11", the selection control circuit 32 supplies to the selector 33, in each four-frame processing period, a selection signal S causing selection of high-order bit pixel data DU in the fourth frame, and of addition high-order bit pixel data $DU_{ADD}$ in each of the first through third frames.

When the number of bits M in the separated low-order bit sequence separated in the bit separation circuit 31 is 3, the selection control circuit 32 performs operations as follows.

When the low-order bit pixel data DL is "000", the selection control circuit 32 always supplies to the selector 33 a selection signal S causing selection of the high-order bit pixel data DU. When the low-order bit pixel data DL is "001", the selection control circuit 32 supplies to the selector 33, in each eight-frame processing period, a selection signal S causing selection of addition high-order bit pixel data $DU_{ADD}$ in the fourth frame, and of high-order bit pixel data DU in the first through third and the fifth through eighth frames. When the low-order bit pixel data DL is "010", the selection control circuit 32 supplies to the selector 33, in each eight-frame processing period, a selection signal S causing selection of addition high-order bit pixel data $DU_{ADD}$ in the second and sixth frames, and of high-order bit pixel data DU in the first, third through fifth, seventh and eighth frames. When the low-order bit pixel data DL is "011", the selection control circuit 32 supplies to the selector 33, in each eight-frame processing period, a selection signal S causing selection of addition high-order bit pixel data $DU_{ADD}$ in the second, fourth and sixth frames, and of high-order bit pixel data DU in the first, third, fifth, seventh and eighth frames. When the low-order bit pixel data DL is "100", the selection control circuit 32 supplies to the selector 33, in each eight-frame processing period, a selection signal S causing selection of addition high-order bit pixel data $DU_{ADD}$ in the first, third, fifth and seventh frames, and of high-order bit pixel data DU in the second, fourth, sixth and eighth frames. When the low-order bit pixel data DL is "101", the selection control circuit 32 supplies to the selector 33, in each eight-frame processing period, a selection signal S causing selection of addition high-order bit pixel data $DU_{ADD}$ in the first, third, fourth, fifth and seventh frames, and of high-order bit pixel data DU in the second, sixth and eighth frames. When the low-order bit pixel data DL is "110", the selection control circuit 32 supplies to the selector 33, in each eight-frame processing period, a selection signal S causing selection of addition high-order bit pixel data $DU_{ADD}$ in the first through third and the fifth through seventh frames, and of high-order bit pixel data DU in the fourth and eighth frames. And when the low-order bit pixel data DL is "111", the selection control circuit 32 supplies to the selector 33, in each eight-frame processing period, a selection signal S causing selection of addition high-order bit pixel data $DU_{ADD}$ in the first through seventh frames, and of high-order bit pixel data DU in the eighth frame.

The selector 33 selects, from among the high-order bit pixel data DU and the addition high-order bit pixel data $DU_{ADD}$, the data indicated by the selection signal S, and supplies this data as selected pixel data DD to the D/A converter 35. The D/A converter 35 converts the supplied selected pixel data DD into an analog image signal, and supplies this analog image signal to the driver 2.

Below, operation of an image signal processing device 3 with the above configuration is explained, using an example illustrated in FIG. 2 to FIG. 5.

Figure 2:
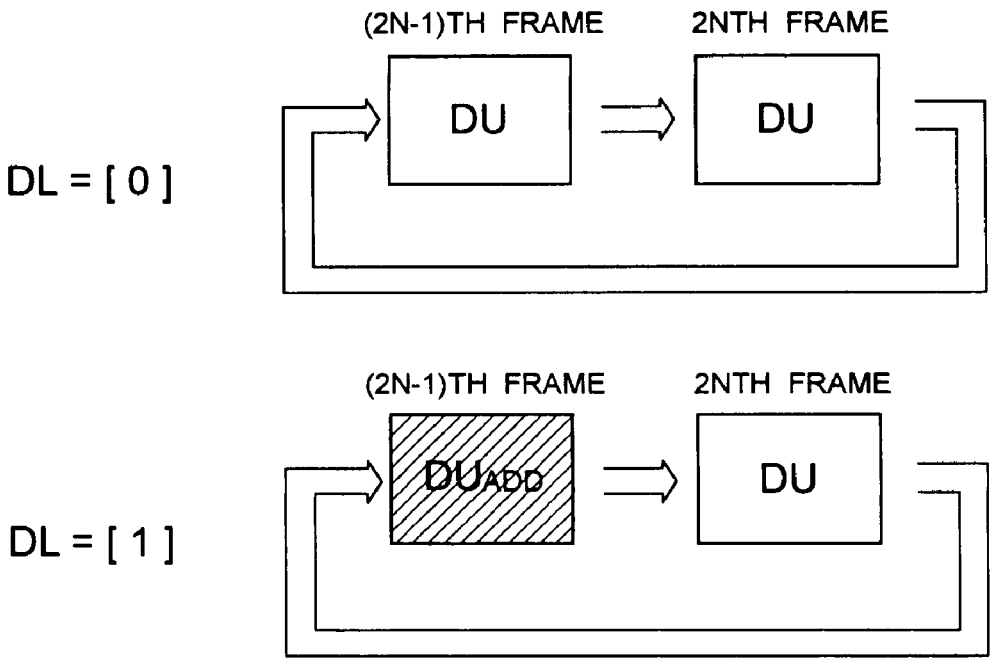
FIG. 2 shows one example of selected pixel data DD input to the D/A converter 35 when the number of bits M of the low-order bit sequence separated in the bit separation circuit 31 shown in FIG. 1 is 1.

FIG. 2 shows selected pixel data DD input to the D/A converter 35, when the number of bits M of the low-order bit sequence separated in the bit separation circuit 31 is 1.

First, when the low-order bit pixel data DL is "1", in the (2n−1)th frame (where n is a natural number), the addition high-order bit pixel data $DU_{ADD}$ is the selected pixel data DD, and in the (2n)th frame, the high-order bit pixel data DU is the pixel data DD for conversion. That is, when the low-order bit pixel data DL is "1", in one frame among the (2n−1)th and (2n)th frames, the addition high-order bit pixel data $DU_{ADD}$ is supplied to the D/A converter 35 as the pixel data DD for conversion. On the other hand, when the low-order bit pixel data DL is "0", the high-order bit pixel data DU is supplied to the D/A converter 35 as the pixel data DD for conversion in all the frames. That is, when the low-order bit pixel data DL is "0", the addition high-order bit pixel data $DU_{ADD}$ is not D/A converted.

Here, when the input pixel data PD is for example 8 bits, the high-order bit pixel data DU is 7-bit data, and the addition high-order bit pixel data $DU_{ADD}$ is 7-bit data obtained by adding "1" to the least significant bit of this high-order bit pixel data DU. That is, the result of adding to the high-order bit pixel data DU the portion carried from the least significant bit of the input pixel data PD becomes the addition high-order bit pixel data $DU_{ADD}$. Here, in a two-frame processing period, the addition high-order bit pixel data $DU_{ADD}$ is to be D/A converted for frames (0 or 1) according in number to the value of the least significant bit of the input pixel data PD, and for the other frames, the high-order bit pixel data DU is to be D/A converted. That is, when the least significant bit of the input pixel data PD is at logic level "0", D/A conversion processing of the least significant bit portion is effectively unnecessary, and so D/A conversion is performed only for the high-order 7-bits portion (DU) of the input pixel data PD. However, when the least significant bit of the input pixel data PD is at logic level "1", this least significant bit must be reflected in the D/A conversion processing. Hence in one frame during a two-frame processing period, the portion carried from the low-order bit to the high-order 7-bits portion (DU) of the input pixel data PD is added to obtain the addition high-order bit pixel data $DU_{ADD}$, which is taken as the data for D/A conversion. By means of this operation, even when the resolution of the D/A converter 35 itself is 7 bits, over a two-frame processing period the resolution of the image ultimately viewed is equivalent to the 8 bits required by the input pixel data PD.

Figure 3:
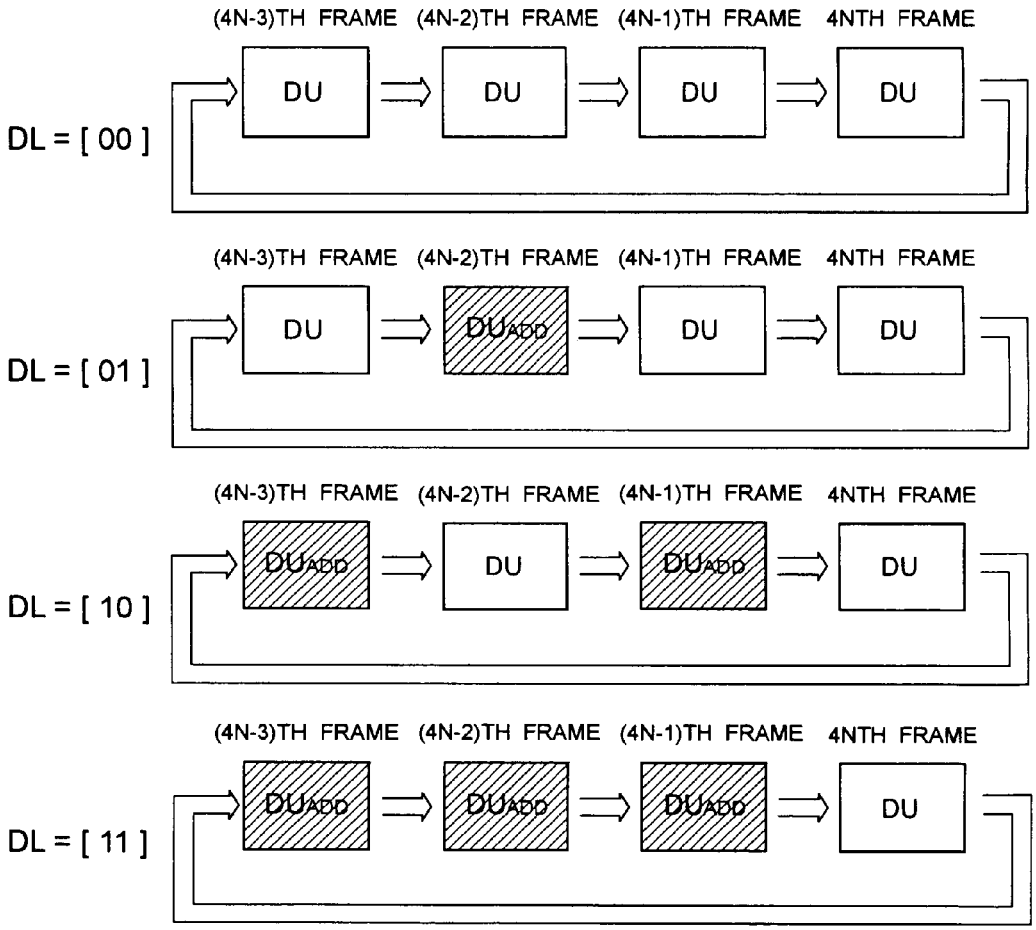
FIG. 3 shows one example of selected pixel data DD input to the D/A converter 35 when the number of bits M of the low-order bit sequence separated in the bit separation circuit 31 shown in FIG. 1 is 2.

FIG. 3 shows the selected pixel data DD input to the D/A converter 35 when the number of bits M of the low-order bit sequence separated in the bit separation circuit 31 is 2.

As shown in FIG. 3, when the low-order bit pixel data DL is "11", in each of the (4n−3)th, (4n−2)th and (4n−1)th frames, the addition high-order bit pixel data $DU_{ADD}$ becomes the selected pixel data DD, and in the (4n)th frames the high-order bit pixel data DU becomes the selected pixel data DD. That is, when the low-order bit pixel data DL is "11", the addition high-order bit pixel data $DU_{ADD}$ is the data for D/A conversion in three frames among four consecutive frames. When the low-order bit pixel data DL is "10", in each of the (4n−3)th and (4n−1)th frames, the addition high-order bit pixel data $DU_{ADD}$ becomes the selected pixel data DD, and in each of the (4n−2)th and (4n)th frames, the high-order bit pixel data DU becomes the selected pixel data DD. That is, when the low-order bit pixel data DL is "10", the addition high-order bit pixel data $DU_{ADD}$ is the data for D/A conversion in two frames among four consecutive frames. When the low-order bit pixel data DL is "01", in each of the (4n−2)th frames, the addition high-order bit pixel data $DU_{ADD}$ becomes the selected pixel data DD, and in each of the (4n−3)th, (4n−1)th and (4n)th frames, the high-order bit pixel data DU becomes the selected pixel data DD. That is, when the low-order bit pixel data DL is "01", the addition high-order bit pixel data $DU_{ADD}$ is the data for D/A conversion in one frame among four consecutive frames. And, when the low-order bit pixel data DL is "00", the high-order bit pixel data DU is the data for conversion DD in all the frames. That is, when the low-order bit pixel data DL is "00", the addition high-order bit pixel data $DU_{ADD}$ is not the data for D/A conversion in any of the frames.

Here, if for example the input pixel data PD is 8 bits, the high-order bit pixel data DU is 6-bit data, and the addition high-order bit pixel data $DU_{ADD}$ is 6-bit data resulting from addition of "1" to the least significant bit of this high-order bit pixel data DU. That is, the result of adding the portion carried from the low-order two bits of the input pixel data PD to the high-order bit pixel data DU becomes the addition high-order bit pixel data $DU_{ADD}$. Here, in each four-frame processing period, the addition high-order bit pixel data $DU_{ADD}$ is to be D/A converted in each of frames (0, 1, 2 or 3) corresponding in number to the value of the low-order two bits of the input pixel data PD, and the high-order bit pixel data DU is to be D/A converted in the other frames. For example, when the low-order two bits of the input pixel data PD are logic level "00", D/A conversion of the least significant bit portion is effectively unnecessary, and so D/A conversion is performed for only the high-order 6-bit portion (DU) of the input pixel data PD. However, when the low-order two-bit portion of the input pixel data PD is other than logic level "00", the value must be reflected in the D/A conversion processing. Hence when the low-order two-bit portion of the input pixel data PD is logic level "01", in a four-frame processing period, the addition high-order bit pixel data $DU_{ADD}$ is the data for D/A conversion in one frame. When the low-order two-bit portion of the input pixel data PD is logic level "10", in a four-frame processing period, the addition high-order bit pixel data $DU_{ADD}$ is the data for D/A conversion in two frames; and when the value is logic level "11", the addition high-order bit pixel data $DU_{ADD}$ is to be D/A converted in three frames. By means of this operation, even if for example the resolution of the D/A converter 35 itself is 6 bits, the resolution of the image ultimately viewed over a four-frame processing period is equivalent to the 8 bits required by the input pixel data PD.

Figure 4:
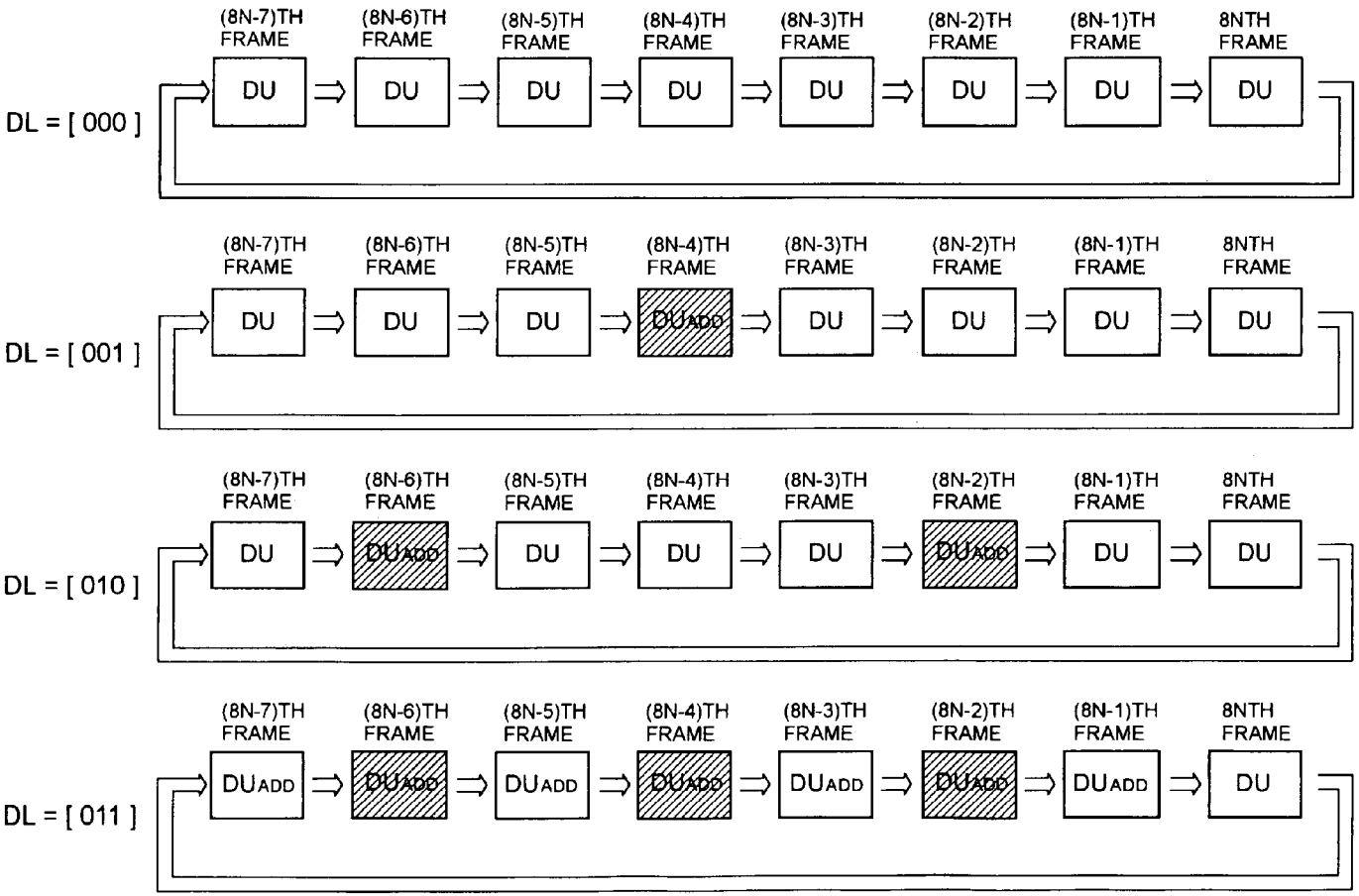
FIG. 4 shows one example of selected pixel data DD input to the D/A converter 35 when the number of bits M of the low-order bit sequence separated in the bit separation circuit 31 shown in FIG. 1 is 3.
Figure 5:
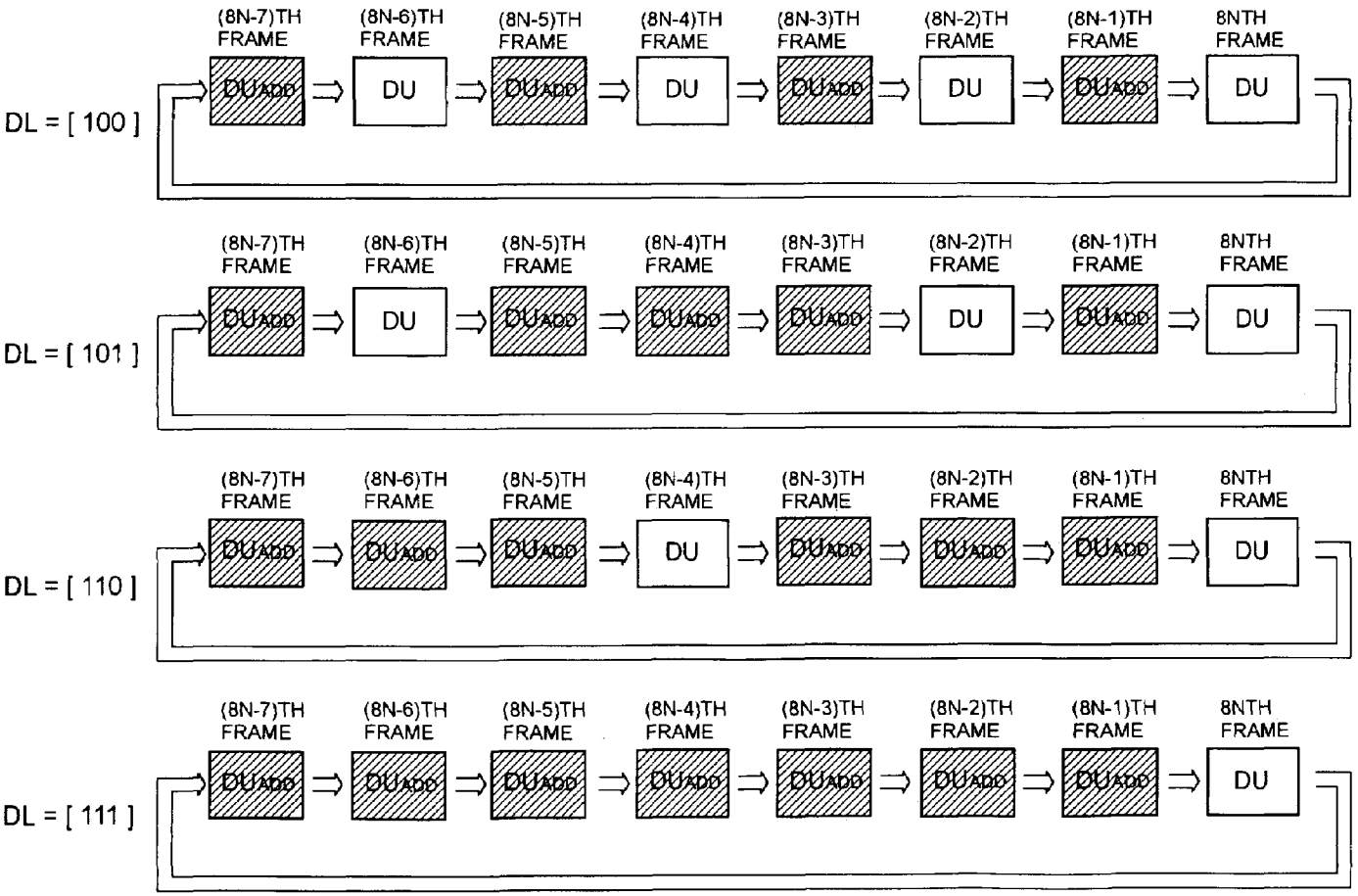
FIG. 5 shows one example of selected pixel data DD input to the D/A converter 35 when the number of bits M of the low-order bit sequence separated in the bit separation circuit 31 shown in FIG. 1 is 3; and, FIG. 6 shows the schematic configuration of a display device provided with an image signal processing device of another embodiment of this invention.

FIG. 4 and FIG. 5 show one example of the selected pixel data DD input to the D/A converter 35 when the number of bit M of the low-order bit sequence separated in the bit separation circuit 31 is 3.

As shown in FIG. 4 and FIG. 5, when the low-order bit pixel data DL is "111", the selected pixel data DD is the addition high-order bit pixel data $DU_{ADD}$ in each of the (8n−7)th, (8n−6)th, (8n−5)th, (8n−4)th, (8n−3)th, (8n−2)th, and (8n−1)th frames, and is the high-order bit pixel data DU in the (8n)th frame. That is, when the low-order bit pixel data DL is "111", the addition high-order bit pixel data $DU_{ADD}$ is to be D/A converted in each of 7 frames among 8 consecutive frames. When the low-order bit pixel data DL is "110", the selected pixel data DD is the addition high-order bit pixel data $DU_{ADD}$ in each of the (8n−7)th, (8n−6)th, (8n−5)th, (8n−3)th, (8n−2)th, and (8n−1)th frames, and is the high-order bit pixel data DU in the (8n−4)th and (8n)th frames. That is, when the low-order bit pixel data DL is "110", the addition high-order bit pixel data $DU_{ADD}$ is to be D/A converted in each of 6 frames among 8 consecutive frames. When the low-order bit pixel data DL is "101", the selected pixel data DD is the addition high-order bit pixel data $DU_{ADD}$ in each of the (8n−7)th, (8n−5)th, (8n−4)th, (8n−3)th, and (8n−1)th frames, and is the high-order bit pixel data DU in the (8n−6)th, (8n−2)th and (8n)th frames. That is, when the low-order bit pixel data DL is "101", the addition high-order bit pixel data $DU_{ADD}$ is to be D/A converted in each of 5 frames among 8 consecutive frames. When the low-order bit pixel data DL is "100", the selected pixel data DD is the addition high-order bit pixel data $DU_{ADD}$ in each of the (8n−7)th, (8n−5)th, (8n−3)th, and (8n−1)th frames, and is the high-order bit pixel data DU in the (8n−6)th, (8n−4)th, (8n−2)th and (8n)th frames. That is, when the low-order bit pixel data DL is "100", the addition high-order bit pixel data $DU_{ADD}$ is to be D/A converted in each of 4 frames among 8 consecutive frames. When the low-order bit pixel data DL is "011", the selected pixel data DD is the addition high-order bit pixel data $DU_{ADD}$ in each of the (8n−6)th, (8n−4)th, and (8n−2)th frames, and is the high-order bit pixel data DU in the (8n−7)th, (8n−5)th, (8n−3)th, (8n−1)th and (8n)th frames. That is, when the low-order bit pixel data DL is "011", the addition high-order bit pixel data $DU_{ADD}$ is to be D/A converted in each of 3 frames among 8 consecutive frames. When the low-order bit pixel data DL is "010", the selected pixel data DD is the addition high-order bit pixel data $DU_{ADD}$ in each of the (8n−6)th and (8n−2)th frames, and is the high-order bit pixel data DU in the (8n−7)th, (8n−5)th, (8n−4)th, (8n−3)th, (8n−1)th and (8n)th frames. That is, when the low-order bit pixel data DL is "010", the addition high-order bit pixel data $DU_{ADD}$ is to be D/A converted in each of 2 frames among 8 consecutive frames. When the low-order bit pixel data DL is "001", the selected pixel data DD is the addition high-order bit pixel data $DU_{ADD}$ in each of the (8n−4)th frames, and is the high-order bit pixel data DU in the other frames. That is, when the low-order bit pixel data DL is "001", the addition high-order bit pixel data $DU_{ADD}$ is to be D/A converted in 1 frame among 8 consecutive frames. And, when the low-order bit pixel data DL is "000", the selected pixel data DD is the high-order bit pixel data DU in each of the (8n−7)th, (8n−6)th, (8n−5)th, (8n−4)th, (8n−3)th, (8n−2)th, (8n−1)th, and (8n)th frames. That is, when the low-order bit pixel data DL is "000", the addition high-order bit pixel data $DU_{ADD}$ is not D/A converted in any of the frames.

Here, when the input pixel data PD is for example 8 bits, the high-order bit pixel data DU is 5-bit data, and the addition high-order bit pixel data $DU_{ADD}$ is 5-bit data obtained by adding "1" to the least significant bit of the high-order bit pixel data DU. That is, the addition high-order bit pixel data $DU_{ADD}$ is obtained by adding the portion carried from the low-order 3 bits of the input pixel data PD to the high-order bit pixel data DU. At this time, in an 8-frame processing period, the addition high-order bit pixel data $DU_{ADD}$ becomes the data for D/A conversion in frames (0, 1, 2, 3, 4, 5, 6, or 7) according in number to the value of the low-order 3 bits of the input pixel data PD, and the high-order bit pixel data DU is the data for D/A conversion in the other frames. By means of this operation, even if for example the resolution of the D/A converter 35 itself is 5 bits, the resolution of the image ultimately viewed over an eight-frame processing period is equivalent to the 8 bits required by the input pixel data PD.

As described above, in the image signal processing device 3, the addition high-order bit pixel data $DU_{ADD}$ is generated by adding, to the high-order bit pixel data DU comprising the high-order (N-M) bits of the input pixel data PD, a value corresponding to the least significant bit digit of the high-order bit pixel data DU. In a $2^M$ frame processing period, the addition high-order bit pixel data $DU_{ADD}$ is the data for D/A conversion in frames corresponding in number to the value of the low-order bit pixel data DL, comprising the low-order M bits of the input pixel data PD, and the high-order bit pixel data DU is the data for D/A conversion in the other frames. That is, in a prescribed period, the addition high-order bit pixel data $DU_{ADD}$ is the data for D/A conversion during a time period according to the value of the low-order bit pixel data DL, and the high-order bit pixel data DU is the data for D/A conversion during the other period.

By means of this configuration, even if the resolution of the D/A converter is lower than the resolution required by the input pixel data, the resolution of the image ultimately viewed over a prescribed period (a $2^M$ frame processing period) is equal to the resolution required by the input pixel data. Hence to the extent that the resolution of the D/A converter can be lowered, the circuit scale can be reduced.

Figure 6:
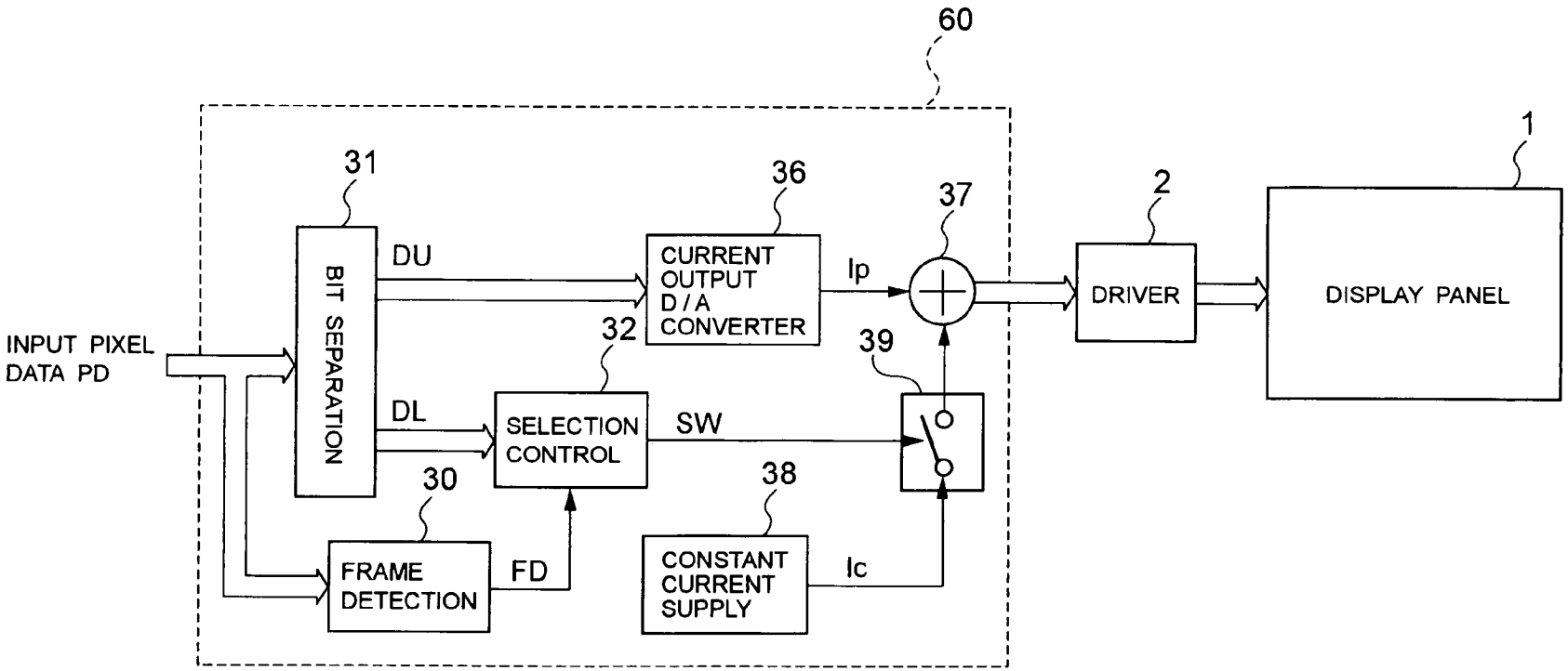

FIG. 6 shows the configuration of a display device provided with the image signal processing device of another embodiment of this invention.

In FIG. 6, the display panel 1 is a display panel in which the pixel cells which represent each pixel are arranged in a matrix, as for example in a liquid crystal display panel, an electroluminescence display panel, or a plasma display panel. The driver 2 generates and supplies to the above display panel 1 various driving signals to cause the display on the screen of the display panel 1 of an image corresponding to the analog image signal supplied from the image signal processing device 60.

The image signal processing device 60 comprises a frame detection circuit 30, bit separation circuit 31, selection control circuit 40, current output D/A converter 36, adder 37, constant current supply 38, and switching element 39.

The frame detection circuit 30 generates a frame detection signal FD each time one frame's worth of input pixel data PD corresponding to pixels of the display panel 1 is supplied, and supplies this frame detection signal FD to the selection control circuit 40. The input pixel data PD is N-bit digital data, and uses N bits to express, for each pixel, the brightness level at which emission in the pixel is to occur.

The bit separation circuit 31 separates the N-bit input pixel data PD into a low-order bit sequence comprising the low-order M-bit portion (where M is a natural number smaller than N) including the least significant bit, and an high-order bit sequence comprising the high-order (N-M) bit portion including the most significant bit. The bit separation circuit 31 supplies the low-order bit sequence, as low-order bit pixel data DL, to the selection control circuit 40, and supplies the high-order bit sequence, as high-order bit pixel data DU, to the current output D/A converter 36.

The current output D/A converter 36 generates and supplies to the adder 37 a pixel data current $I_P$ having a current value corresponding to the value expressed by the high-order bit pixel data DU. That is, the current output D/A converter 36 converts the brightness level of each pixel, represented by the high-order (N-M) bit of the input pixel data PD, into a pixel data current $I_P$ having a current value corresponding to the brightness level, and supplies [the pixel data current $I_P$] to the adder 37.

The constant current supply 38 generates and supplies to the switching element 39 a carry-up pixel data current $I_C$ having a current value corresponding to the brightness level when the least significant bit digit in the high-order bit pixel data DU is at logic level "1".

The selection control circuit 40 first detects, based on the frame detection signal FD, whether $2^M$ frames' worth of input pixel data PD has been supplied. Here, each time the supply of $2^M$ frames' worth of input pixel data PD is detected, the selection control circuit 40 captures the low-order bit pixel data DL for each pixel based on one frame's worth of input pixel data PD. Based on the low-order bit pixel data DL for each pixel in the capture one frame's worth of data, the selection control circuit 40 then generates a switching signal SW which specifies, in each of the frames in the following $2^M$ frame processing period, whether a carry-up pixel data current $I_C$ is to be supplied to the adder 37. Here, the selection control circuit 40 supplies to the switching element 39 a switching signal SW specifying the on state for frames corresponding in number to a value of the low-order bit pixel data DL in the $2^M$ frame processing period, as described above, and specifying the off state for the other frames.

For example, if the number of bits M of the low-order bit sequence separated in the bit separation circuit 31 is 2, the selection control circuit 40 performs operations as follows.

First, when the low-order bit pixel data DL is "00", the selection control circuit 40 supplies to the switching element 39 a switching signal SW which specifies the off state for each of the first through fourth frames in each four-frame processing period. When the low-order bit pixel data DL is "01", the selection control circuit 40 supplies to the switching element 39 a switching signal SW which specifies the on state for the second frame and the off state for the other frames in each four-frame processing period. When the low-order bit pixel data DL is "10", the selection control circuit 40 supplies to the switching element 39 a switching signal SW which specifies the off state for the first and third frames and the on state for the second and fourth frames in each four-frame processing period. And, when the low-order bit pixel data DL is "11", the selection control circuit 40 supplies to the switching element 39 a switching signal SW which specifies the on state for the first through third frames and the off state for the fourth frame in each four-frame processing period.

The switching element 39 is in the on state only when a switching signal SW specifying the on state is supplied, and [when in the on state] supplies the above carry-up pixel data current $I_C$ to the adder 37.

When the carry-up pixel data current $I_C$ is supplied by the switching element 39, the adder 37 supplies to the driver 2 an analog image signal having a level corresponding to the current value obtained by adding the above pixel data current $I_P$ and the carry-up pixel data current $I_C$. On the other hand, when the carry-up pixel data current $I_C$ is not supplied by the switching element 39, the adder 37 supplies to the driver 2 an analog image signal having a level corresponding to the current value indicated by the above pixel data current $I_P$.

Below, operation of the image signal processing device 60 is explained for an example in which the number of bits of the input pixel data PD is 8 bits, and the number of bits M of the low-order bit sequence separated in the bit separation circuit 31 is 2.

Here, the current output D/A converter 36 converts the high-order bit pixel data DU comprising the high-order 6 bits of the input pixel data PD into a pixel data current $I_P$ having a current value corresponding to the value [of the high-order bit pixel data DU]. Further, by means of the constant current supply 38, a carry-up pixel data current $I_C$ is generated having a current value corresponding to the brightness level when the least significant bit of the high-order bit pixel data DU is at logic level "1".

When the low-order bit pixel data DL is "00", an analog image signal corresponding to the pixel data current $I_P$ is supplied to the driver 2. When the low-order bit pixel data DL is "01", in each four-frame processing period, analog image signals are supplied to the driver 2 corresponding to the image data current $I_P$ in each of the first through third frames, and corresponding to the current equal to (the pixel data current $I_P$+the carry-up pixel data current $I_C$) in each fourth frame. When the low-order bit pixel data DL is "10", in each four-frame processing period, analog image signals are supplied to the driver 2 corresponding to the image data current $I_P$ in each of the first and third frames, and corresponding to the current equal to (the pixel data current $I_P$+the carry-up pixel data current $I_C$) in each of the second and fourth frames. And, when the low-order bit pixel data DL is "11", in each four-frame processing period, analog image signals are supplied to the driver 2 corresponding to the current equal to (the pixel data current $I_P$+the carry-up pixel data current $I_C$) in each of the first through third frames, and corresponding to the pixel data current $I_P$ in each of the fourth frames.

That is, in the image signal processing device 60 shown in FIG. 6, by D/A converting the high-order bit pixel data DU comprising an high-order bit sequence in the input pixel data PD, a pixel data current $I_P$ is obtained having a current value corresponding to the high-order bit pixel data DU. An analog image signal corresponding to this pixel data current $I_P$ is then supplied to the driver 2. Here, in every $2^M$ frame processing period, a carry-up pixel data current $I_C$ corresponding to the least significant bit digit of the high-order bit pixel data DU is added to the pixel data current $I_P$ in each of frames corresponding in number to the value of the low-order bit pixel data DL, comprising a low-order bit sequence in the input pixel data PD. That is, a carry-up pixel data current $I_C$ corresponding to the least significant bit digit of the high-order bit pixel data DU is added to the pixel data current $I_P$ only in a time period determined according to the value of the low-order bit pixel data DL in a prescribed period.

By means of this configuration, similarly to the image signal processing device 3 shown in FIG. 1, even if for example the resolution of the D/A converter is lower than the resolution required by the input pixel data, the resolution of the image ultimately viewed over a prescribed period (a $2^M$ frame processing period) is equivalent to the resolution required by the input pixel data. Consequently to the extent that the resolution of the D/A converter can be lowered, the scale of the circuit can be reduced.

In the above embodiment, based on one frame's worth of low-order bit pixel data DL, the selection sequence for D/A conversion data within the following $2^M$ frame processing period is determined; but this invention is not limited to such operation. For example, selection of the data for D/A conversion can be performed, based on the low-order bit pixel data DL, each time one frame's worth of low-order bit pixel data DL is captured.

Below, this operation is explained for an example in which the number of bits M of the low-order bit pixel data DL is 2, using the display device shown in FIG. 1.

First, in the (4N−3)th frame as shown in FIG. 3, when the low-order bit pixel data DL of the first frame is "00" or "01", the selection control circuit 32 supplies to the selector 33 a selection signal S causing selection of the high-order bit pixel data DU. On the other hand, in the (4N−3)th frame, when the low-order bit pixel data DL is "10" or "11", the selection control circuit 32 supplies to the selector 33 a selection signal S causing selection of the addition high-order bit pixel data $DU_{ADD}$.

Next, in the (4N−2)th frame as shown in FIG. 3, when the low-order bit pixel data DL of the one frame is "00" or "10", the selection control circuit 32 supplies to the selector 33 a selection signal S causing selection of the high-order bit pixel data DU. On the other hand, in the (4N−2)th frame, when the low-order bit pixel data DL is "01" or "11", the selection control circuit 32 supplies to the selector 33 a selection signal S causing selection of the addition high-order bit pixel data $DU_{ADD}$.

Next, in the (4N−1)th frame as shown in FIG. 3, when the low-order bit pixel data DL of the first frame is "00" or "01", the selection control circuit 32 supplies to the selector 33 a selection signal S causing selection of the high-order bit pixel data DU. On the other hand, in the (4N−1)th frame, when the low-order bit pixel data DL is "10" or "11", the selection control circuit 32 supplies to the selector 33 a selection signal S causing selection of the addition high-order bit pixel data $DU_{ADD}$.

And, in the 4Nth frame as shown in FIG. 3, regardless of the value of the low-order bit pixel data DL, the selection control circuit 32 supplies to the selector 33 a selection signal S causing selection of the high-order bit pixel data DU.

By means of such selection control, when input pixel data PD expressing a still image is supplied, the same operation as the operation shown in FIG. 3 is performed.

That is, in the four-frame processing period comprising the (4N−3)th, (4N−2)th, (4N−1)th, and 4Nth frames, the addition high-order bit pixel data $DU_{ADD}$ becomes the data for D/A conversion in frames (0, 1, 2 or 3) according in number to the value of the low-order two bits of the input pixel data PD, and in other frames the high-order bit pixel data DU becomes the data for D/A conversion.

This application is based on a Japanese patent application No. 2003-69709 which is hereby incorporated by reference.

What is claimed is:

1. An image signal processing device, which converts input pixel data corresponding to each of the pixels of a display panel into an analog image signal, comprising:

a calculation portion for adding high-order bit pixel data to a value corresponding to the least significant bit digit in said high-order bit pixel data to obtain addition high-order bit pixel data, said high-order bit pixel data being constituted by high-order consecutive bits of said input pixel data;

a selection portion for selecting either said addition high-order bit pixel data or said high-order bit pixel data in accordance with a value of low-order bit pixel data, said low-order bit pixel data being constituted by low-order consecutive bits of said input pixel data; and, a D/A conversion portion for performing digital-to-analog conversion of the selected pixel data to obtain said analog image signal.

2. An image signal processing device according to claim 1, wherein said selection portion selects said addition high-order bit pixel data during a time period corresponding to value of said low-order bit pixel data in a prescribed unit period, and selects said high-order bit pixel data during other period in said prescribed unit period.

3. An image signal processing device according to claim 1, wherein said low-order bit pixel data comprises low-order consecutive M bits (M is a natural number) of said input pixel data, and in image signal processing of each consecutive $2^M$ frame's worth of said input pixel data, said selection portion selects said addition high-order bit pixel data for frames corresponding in number to a value of said low-order bit pixel data, and selects said high-order bit pixel data for the other frames.

4. An image signal processing device according to claim 1, wherein said low-order bit pixel data comprises low-order consecutive M bits including the least significant bit of said input pixel data comprising N-bit (N is a natural number, and M is a natural number smaller than N), and said high-order bit pixel data comprises high-order consecutive (N-M) bit including the most significant bit of said input pixel data.

5. An image signal processing device, which converts input pixel data corresponding to each of the pixels of a display panel into an analog image signal, comprising:

a D/A conversion portion for performing digital-to-analog conversion processing of high-order bit pixel data comprising high-order consecutive bits in said input pixel data to obtain an analog signal; and, a calculation portion for outputting an addition result, as said analog image signal, of said analog signal and a value corresponding to the least significant bit digit in said high-order bit pixel data in accordance with a value of low-order bit pixel data, said low-order bit pixel data being constituted by low-order consecutive M bits (M is a natural number) of said input pixel data, wherein upon image signal processing of said input pixel data contained by each consecutive $2^m$ frames, said calculation portion outputs said addition result as said analog image signal for frames corresponding in number to a value of said low-order bit pixel data, and outputs said analog signal as said analog image signal for the other frames.

* * * * *